US006018638A

United States Patent [19]

Li

[11] Patent Number: 6,018,638

[45] Date of Patent: Jan. 25, 2000

[54] DEVELOPER CONTAINER COVER WITH ROTARY SEALING MEANS

[75] Inventor: Kuan-Tung Li, Wu-Chi, Taiwan

[73] Assignee: General Plastic Industrial Co., Ltd., Taichung, Taiwan

[21] Appl. No.: 09/283,325

[22] Filed: Mar. 31, 1999

[51] Int. Cl.[7] ..... G03G 15/08

[52] U.S. Cl. ..... 399/106; 222/554; 222/DIG. 1; 399/260

[58] Field of Search ..... 399/106, 260; 222/554, DIG. 1

[56] References Cited

U.S. PATENT DOCUMENTS

| | | | |
|---|---|---|---|
| 1,772,379 | 8/1930 | Witt | 222/554 |
| 3,194,441 | 7/1965 | Brown | 222/554 |
| 3,540,631 | 11/1970 | Schmidt | 222/554 X |
| 5,040,024 | 8/1991 | Fukuda et al. | 399/106 |
| 5,111,976 | 5/1992 | Ban | 222/DIG. 1 |
| 5,419,468 | 5/1995 | Taki | 222/554 |

*Primary Examiner*—Fred L Braun
*Attorney, Agent, or Firm*—Pro-Techtor International Services

[57] ABSTRACT

A developer container which includes a connector element that connects a container body to an image forming apparatus. The connector has three openings therein. The first and second opening of the connector define a throughway for the developer. The third opening is situated between the first and second openings, and receives a rotating sealing member. The sealing member is rotated to open and close the throughway of the connector.

3 Claims, 4 Drawing Sheets

DEVELOPER CONTAINER COVER WITH ROTARY SEALING MEANS

BACKGROUND OF THE INVENTION

The present invention relates to a developer container for use with a developer replenishing device in a copier, facsimile apparatus, printer or similar electrophotographic image forming apparatus, and more particularly to such a developer container which has a rotary sealing cap rotated to close/open its developer output port.

A developer container for use with a developer replenishing device in a copier, facsimile apparatus, printer or similar electrophotographic image forming apparatus, generally comprises a container portion having an opening through which developer is supplied in or out, a shutter member for opening and closing the opening. After installation of the developer container in the electrophotographic image forming apparatus, the shutter member is pulled away from the container body to open the opening for enabling contained developer to be driven out of the opening. This design is seen in U.S. Pat. No. 5,649,270. However, this design requires much installation space. After installation of the developer container, sufficient space must be provided within the electrophotographic image forming apparatus around the opening of the developer container for the movement of the shutter member of the developer container, so that the shutter member can be detached from the developer container. Further, the shutter member tends to be broken when it is pulled away from the container portion.

SUMMARY OF THE INVENTION

The present invention has been accomplished to provide a developer container which eliminates the aforesaid problems. According to one aspect of the present invention, the developer container comprises a container body having a bottle neck through which developer is supplied in and out, a three-way connector, the connector having a first opening at one end connected to the bottle neck of the container body, a second opening for developer output, and a third opening on the middle in communication between the first and second openings, and a rotary sealing member installed in the third opening and rotated between a first position where the passage between the first opening and the second opening is closed, and a second position where the passage between the first opening and the second opening is opened.

DETAILED DESCRIPTION OF THE PREFERRED EMBODIMENT

Figure 1:
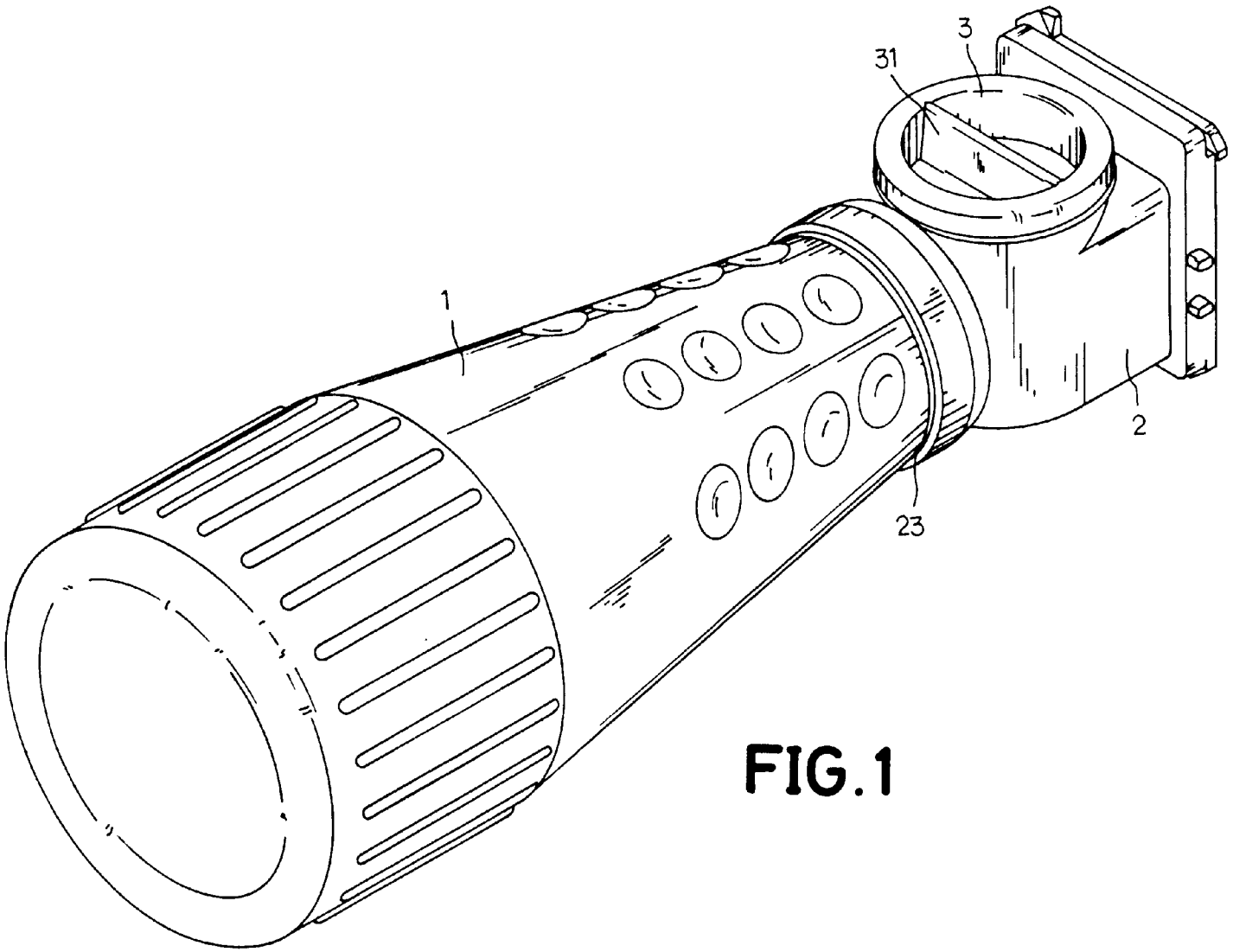
FIG. 1 is a perspective view of a developer container according to the present invention.
Figure 2:
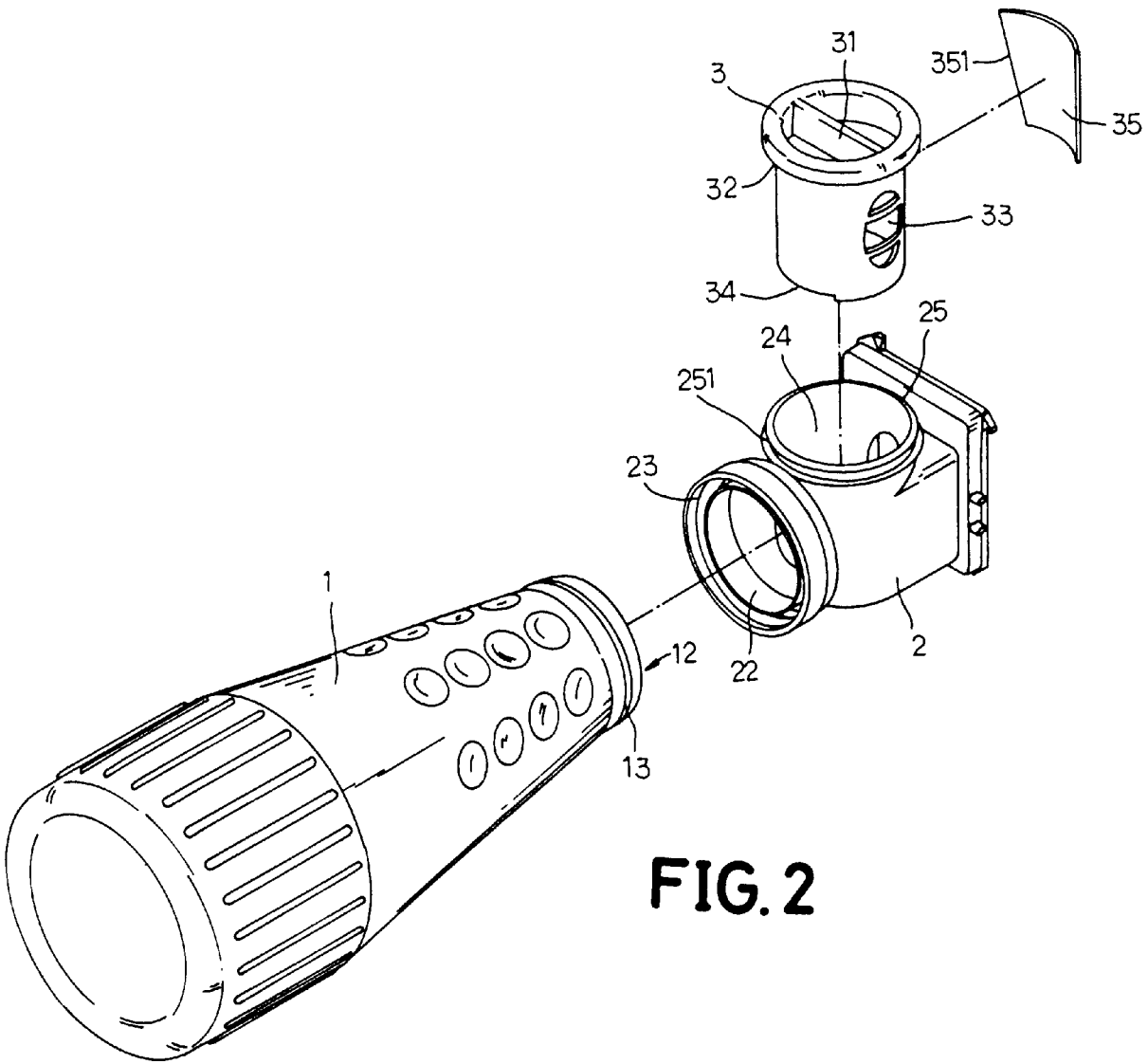
FIG. 2 is an exploded view of the developer container shown in FIG. 1.

Referring to FIGS. 1 and 2, a developer container in accordance with the present invention is generally comprised of a container body 1, a connector 2, and a rotary sealing member 3.

Figure 3:
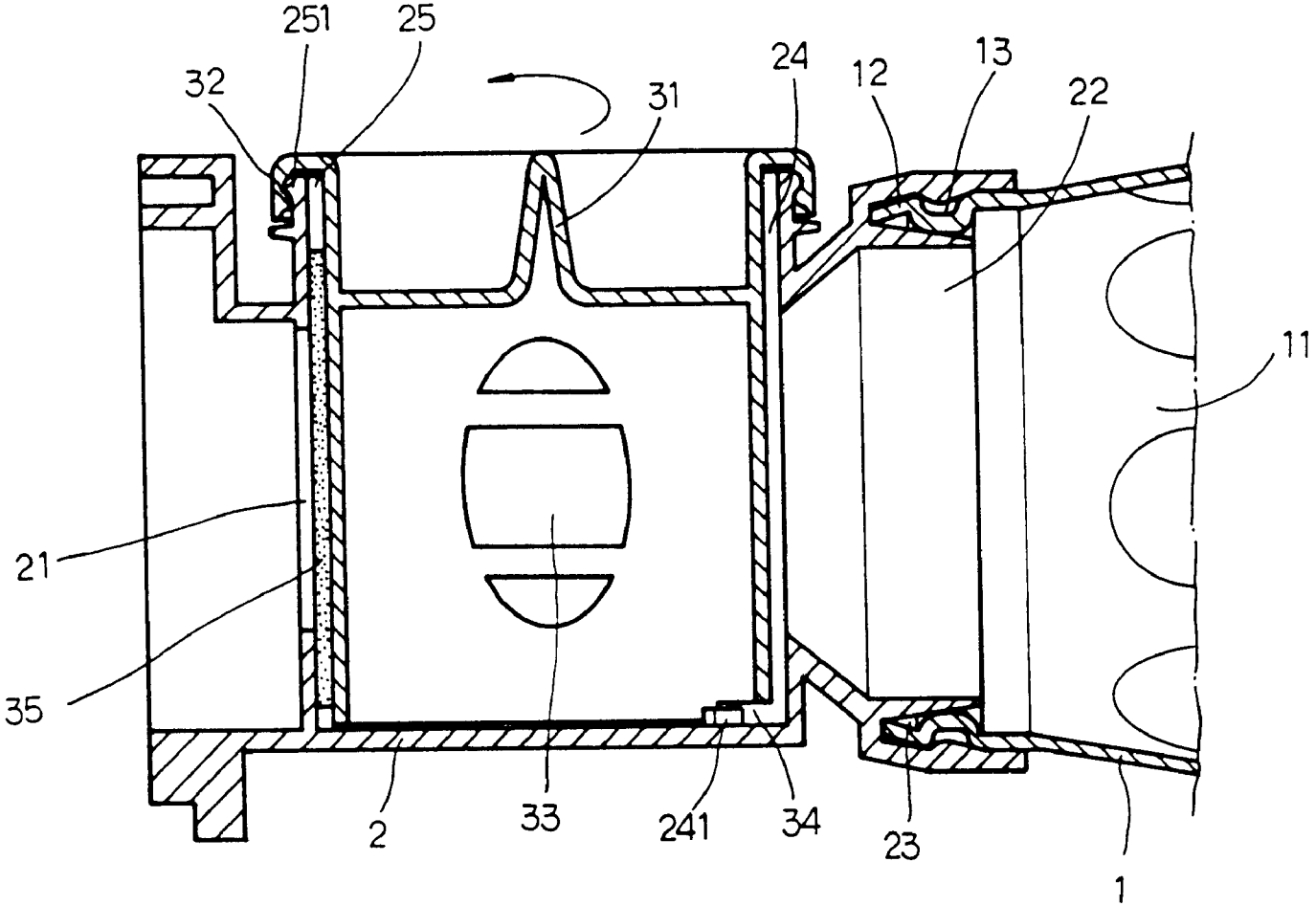
FIG. 3 is a sectional view in an enlarged scale of the front part of the developer container according to the present invention.

Referring to FIG. 3 and FIGS. 1 and 2 again, the container body 1 comprises a developer storage chamber 11, a bottle neck 12 at one end thereof through which developer is supplied in or out of the developer storage chamber 11, and a coupling groove 13 around the periphery of the bottle neck 12. The connector 2 is a three-way fitting coupled to the bottle neck 12 of the container body 1, having a first opening 21 at one end, a second opening 22 at an opposite end in line with the first opening 21, a third opening 24 disposed on the middle in communication with the first opening 21 and the second opening 22, a coupling flange 23 raised on the inside around the second opening 22 for engaging the coupling groove 13 at the bottle neck 12 of the container body 1, a rim 25 raised around the periphery of the third opening 24, a coupling groove 251 disposed around the rim 25, and a stop rib 241 on the inside below the third opening 24. The rotary sealing member 3 is inserted into the third opening 24, and rotated to close/open the passage between the first opening 21 and the second opening 22. The rotary sealing member 3 comprises a finger strip 31 at its top side, a coupling flange 32 raised around the periphery near the top for engaging the coupling groove 251 at the rim 25 of the connector 2, a recessed guide portion 34 at its bottom side, and transverse through hole 33 extended through the periphery thereof and spaced between the coupling flange 32 and the recessed guide portion 34.

Figure 4:
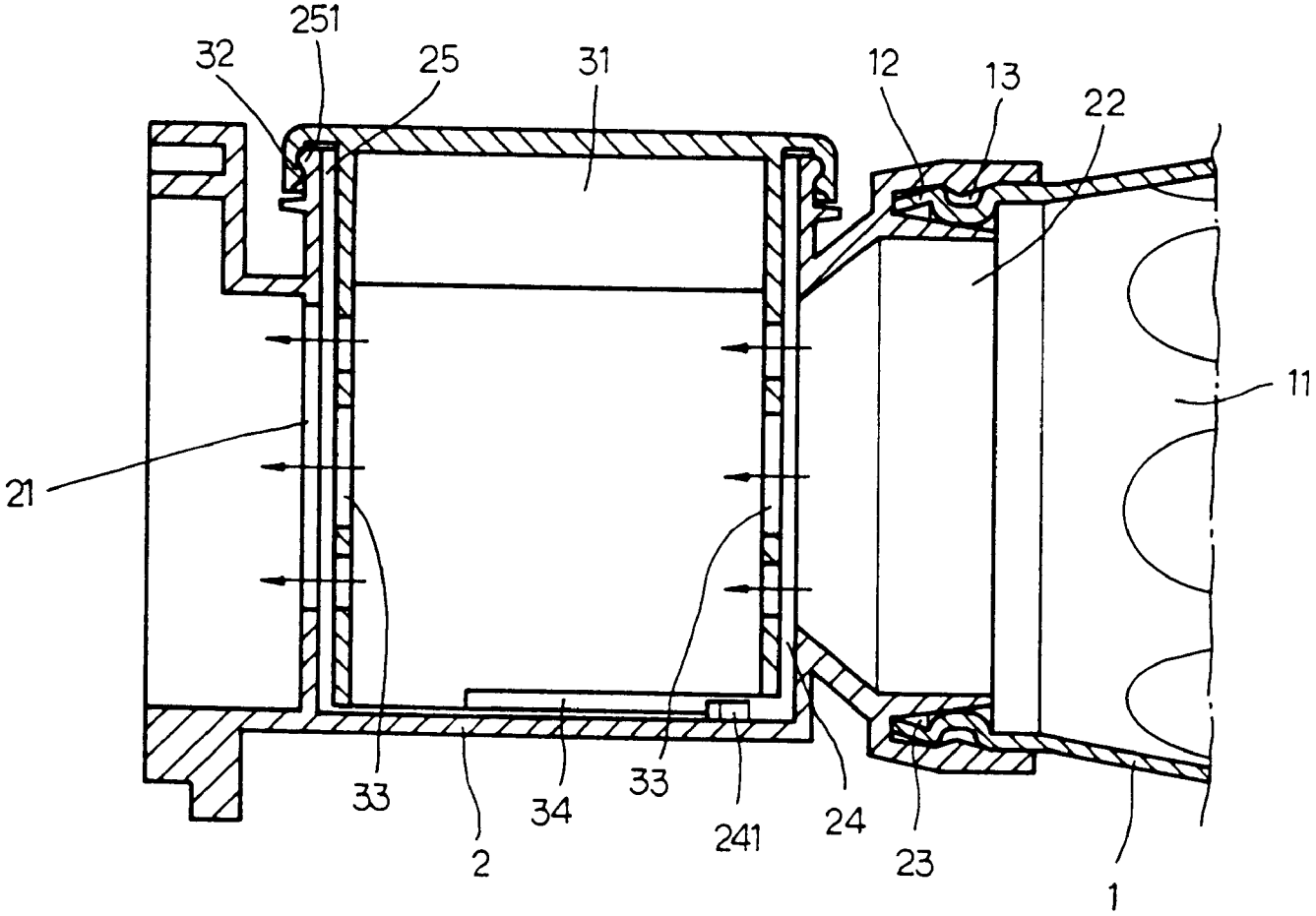
FIG. 4 is similar to FIG. 3 but showing the rotary sealing member rotated to the opening position.

Referring to FIGS. 3 and 4, the rotary sealing member 3 can be rotated between the closing position where the transverse through hole 33 is moved away from the first opening 21 and second opening 22 at the connector 2 and the passage between the first opening 21 and second opening 22 in the connector 2 is closed (see FIG. 3), and the opening position wherein the transverse through hole 33 is aligned between the first opening 21 and second opening 22 at the connector 2 for enabling developer to be driven out of the developer container 1 for application (see FIG. 4). The arrangement of the recessed guide portion 34 at the rotary sealing member 3 and the stop rib 241 at the connector 2 limits the turning angle of the rotary sealing member 3 in the third opening 24 between the closing position and the opening position.

Referring to FIGS. 2 and 4 again, a flexible pad 35 is adhered to the periphery of the rotary sealing member 3. The flexible pad 35 seals the first opening 21 at the connector 2 when the rotary sealing member 3 is turned to the closing position. The flexible pad 35 has a beveled edge 351 at one side, which guides developer from the area between the rotary sealing member 3 and the third opening 24 toward the first opening 21 when developer is driven out of the bottle neck 12 of the container body 1 through the second opening 22 to the first opening 21.

While only one embodiment of the present invention has been shown and described, it will be understood that various modifications and changes could be made thereunto without departing from the spirit and scope of the invention disclosed.

What the invention claimed is:

1. A developer container adapted for use with a developer replenishing device in a copier, facsimile apparatus, printer or similar electrophotographic image forming apparatus, the developer container comprising:

a container body comprising a bottle neck at a front end thereof through which developer passes, said bottle neck includes a coupling groove around an end of said bottle neck;

a connector connected to the bottle neck of said container body, said connector comprising a first opening at one end, a second opening at an opposite end in line with said first opening, a third opening disposed between said first opening and said second opening, a coupling flange disposed inside said second opening and forced into engagement with the coupling groove at the bottle neck of said container body, a rim raised around a periphery of said third opening, a coupling groove disposed around said rim; and a rotary sealing member that is inserted into the third opening at said connector and is rotated to close and open a passage between the first opening and the second opening in said connector, said rotary sealing member comprising a coupling flange raised around the periphery of an upper end of said rotary sealing member that engages the coupling groove at the rim of said connector, and a transverse through hole extended through said rotary sealing member;

wherein said rotary sealing member is rotated in the third opening in said connector between a first position where said transverse through hole is moved away from the first opening and the second opening at said connector, causing the passage between the first opening and the second opening of said connector to be closed by said rotary sealing member, and a second position where said transverse through hole is aligned with the first opening and the second opening of said container so as to allow developer to pass from the bottle neck of said container body through the second opening and the first opening of said connector to the outside of said connector.

2. The developer container of claim 1 wherein said rotary sealing member has a recessed guide portion at a bottom side wall thereof, and said connector has a stop rib on the inside for engagement with the recessed guide portion of said rotary sealing member to stop said rotary sealing member in said third opening between said first position and said second position.

3. The developer container of claim 1 wherein said rotary sealing member has a flexible pad adhered to the periphery thereof, said flexible pad having a beveled side edge, which guides developer from the area between said rotary sealing member and said third opening toward said first opening.

* * * * *